US006930659B1

(12) United States Patent
Hoshino et al.

(10) Patent No.: US 6,930,659 B1
(45) Date of Patent: Aug. 16, 2005

(54) LIGHT EMITTING INDICATOR DRIVE CIRCUIT

(75) Inventors: Masafumi Hoshino, Chiba (JP); Susumu Fujita, Chiba (JP); Tokuya Akase, Chiba (JP); Hiroshi Odagiri, Chiba (JP); Kazumi Sakumoto, Chiba (JP)

(73) Assignee: Seiko Instruments Inc., Chiba (JP)

( * ) Notice: Subject to any disclaimer, the term of this patent is extended or adjusted under 35 U.S.C. 154(b) by 458 days.

(21) Appl. No.: 09/609,181

(22) Filed: Jun. 30, 2000

(30) Foreign Application Priority Data

Jul. 2, 1999 (JP) ..... P1999-188514

(51) Int. Cl.[7] ..... G09G 3/34
(52) U.S. Cl. ..... 345/84; 345/204
(58) Field of Search ..... 345/34, 36, 38, 345/39, 45, 46, 48, 82–84, 89–91, 204–206, 690–691, 695

(56) References Cited

U.S. PATENT DOCUMENTS 4,222,644 A * 9/1980 Tano et al. ..... 396/292
4,479,121 A * 10/1984 Tabata ..... 345/105

FOREIGN PATENT DOCUMENTS

| | | |
|---|---|---|
| JP | 47-041325 | 12/1972 |
| JP | 58-190986 | 11/1983 |
| JP | 09-305146 | 11/1997 |
| JP | 10-254410 | 9/1998 |

* cited by examiner

*Primary Examiner*—Henry N. Tran
*Assistant Examiner*—Jean Lesperance
(74) *Attorney, Agent, or Firm*—Adams & Wilks

(57) ABSTRACT

In a light emitting indicator drive circuit which supplies a current to display elements different in display areas, a constant-current is supplied from a P-channel MOS-FET to a display element and a pulse width control circuit controls a on/off ratio. deterioration information from a deterioration detecting circuit and saved segment area information is calculated, and its result decides a time to supply a current to the display elements as a result of the arithmetic operation. With the above operation, a difference in luminance between the display elements and the degradation of luminance caused by the deterioration can be corrected.

11 Claims, 3 Drawing Sheets

LIGHT EMITTING INDICATOR DRIVE CIRCUIT

BACKGROUND OF THE INVENTION

1. Field of the Invention

The present invention relates to a drive circuit of an indicator that emits a light by supplying a d.c. current, and to a light emitting indicator drive circuit that conducts a correcting process for reducing a difference in the luminance of emitted light of a plurality of display elements each having a different area.

2. Description of the Related Art

FIG. 5 shows a conventional light emitting indicator drive circuit. Also, FIG. 6 is a plan view showing the element shape of a conventional light emitting indicator. Display elements 501 to 520 showed in FIG. 5 are connected to each other in the form of a matrix. An output of a constant-current source 521 having a switching function and allowing a current to flow out is connected to the plus electrode sides of each of the display elements 501, 506, 511 and 516. Likewise, an output of a constant-current source 522 is connected to the display elements 502, 507, 512 and 517, an output of a constant-current source 523 is connected to the display elements 503, 508, 513 and 518, an output of a constant-current source 524 is connected to the display elements 804, 509, 514 and 519, and an output of a constant-current source 525 is connected to the display elements 505, 510, 515 and 520, respectively. On the other hand, a switch 526 that allows a current to flow into the ground is connected to the minus electrode sides of the display elements 501, 502, 503, 504 and 505, respectively. a switch 527 is connected to the display elements 506, 507, 508, 509 and 510, a switch 528 is connected to the display elements 511, 512, 513, 514 and 515, and a switch 529 is connected to the display elements 516, 517, 518, 519 and 520, respectively.

As shown in FIG. 6, in the conventional example, the areas of the display elements disposed within the light emitting indicator 61 are identical with each other, and the constant current sources 521 to 525 supply the same current. For that reason, the current densities of all the display elements become equal to each other, to thereby obtain substantially the same luminance.

In order to turn on/off the respective display elements, each of the constant current sources 521 to 525 has a switching function so that the respective constant current sources can be turned on/off. On the other hand, the switches 526 to 529 are sequentially turned on one by one in a time sharing manner, and there is no case where two or more switches are turned on at the same time. In the case of turning on the display element 501, the constant current source 521 and the switch 526 are turned on. Similarly, all the display elements can be selectively turned on by the combination of the constant current sources 521 to 525 with the switches 526 to 529.

With the above structure, a very large number of light emitting elements are arranged to conduct dot matrix display, thereby being capable of executing various display.

If the dot matrix display is applied to an indicator such as a wristwatch which requires a small size and a low power, the power consumption of the driver and the chip size become large, and also if no fine dot matrix display is used, fine character display cannot be made. In this case, segment display is advantageous, but it is difficult to make the areas of the respective segments identical with each other, as a result of which if the segments are driven by a constant current source having the same current value, the density of current depends on the area of the respective segments to produce a difference in luminance between the respective segments.

In particular, even a difference of several percent in luminance between the adjacent segments is conspicuous. For that reason, if the luminance between the respective segments is not corrected, the display quality is remarkably degraded so that the dot matrix display cannot be applied to a wristwatch that requires high fashionability, or the like.

SUMMARY OF THE INVENTION

The present invention has been made to solve the above drawbacks, and therefore an object of the present invention is to provide a light emitting indicator drive circuit which is capable of correcting a difference in luminance between the respective segments to a level where there occurs no problem from the visual viewpoint.

In order to achieve the above object, according to the present invention, there is provided a light emitting indicator drive circuit in which a gate voltage of a MOS-FET which is a constant-current source that drives display segments is made constant to limit the current value to be constant, and the inverter is pulse-width controlled or frame-modulate controlled by using segment area information, light emitting characteristic degradation information or the like.

BRIEF DESCRIPTION OF THE DRAWINGS

Other features and advantages will become apparent from the following detailed description when taken in conjunction with the accompanying drawings, in which.

DETAILED DESCRIPTION OF THE PREFERRED EMBODIMENTS

Now, a description will be given in more detail of preferred embodiments of the present invention with reference to the accompanying drawings.

Figure 1:
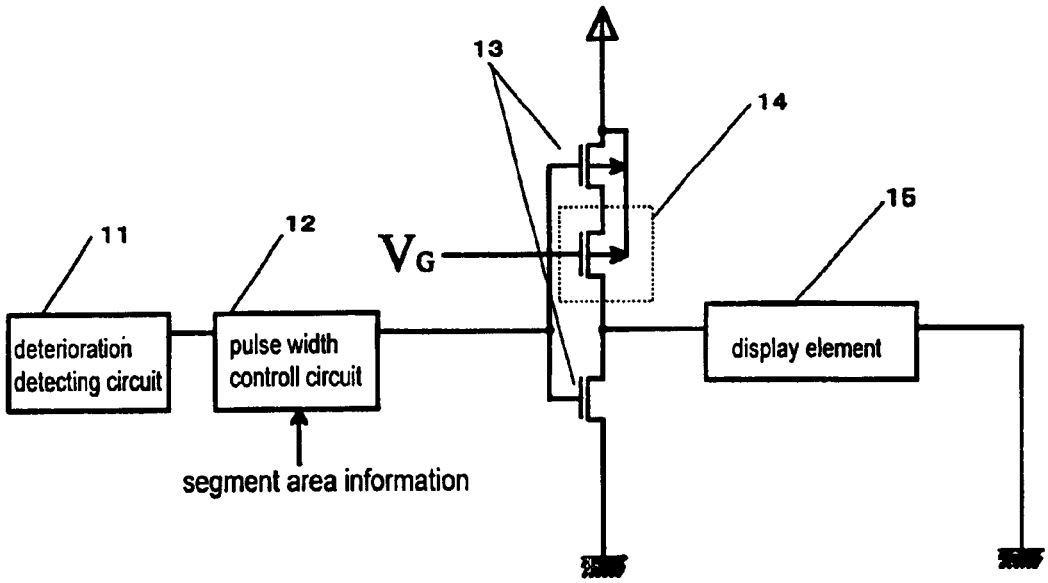
FIG. 1 is a block diagram showing a light emitting indicator drive circuit in accordance with the present invention.

FIG. 1 is a block diagram showing a configuration of a light emitting indicator drive circuit. A display element 15 is provided with a P-channel MOS-FET 14. Then, a constant voltage VG is supplied to a gate electrode of the FET 14, whereby a stable current is caused to flow in accordance with the constant current characteristics of the FET 14. An inverter 13 is electrically connected to a drain and a source of the FET 14 to turn on or off the supply of the power source voltage to the FET 14. In addition, the inverter 13 is controlled by a signal which is supplied from a pulse width control circuit 12. Segment area information which has been stored in a register or the like and degradation information which has been supplied from a degradation detecting circuit 11 are both supplied to the pulse width control circuit 12. Then, a predetermined arithmetic processing is executed using both of the information to generate a pulse having a proper width which is in turn supplied to the inverter 13. As a result, it is possible to correct the luminance difference between light emitting elements two by two of the display elements 15 and others, and the luminance reduction due to the degradation.

The deterioration detecting circuit 11 measures a variation in the voltage-current characteristic of the display element 15 or the like and determines the degree of deterioration to generate data for compensating for the deterioration.

Figure 2:
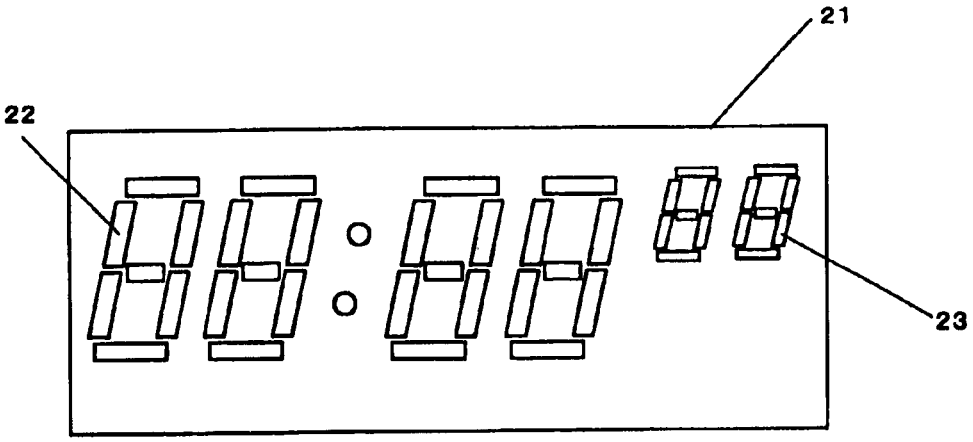
FIG. 2 is a plan view showing a light emitting indicator driven by the light emitting indicator drive circuit in accordance with the present invention.

FIG. 2 shows a plan view of the light emitting indicator in accordance with the present invention. Referring to FIG. 2, a light emitting display panel 21 is provided with four digits of 7-segment display elements 22 which are relatively large in size and 8-shaped ont he left side and two digits of 7-segment display elements 23 which are relatively small in size and 8-shaped on the right side. This is a light emitting display panel for indication of a watch in which the four figures on the left side indicate hours and minutes of a time and the two figures on the right side indicate seconds. There is a difference in area between the seven segments that constitute one display element 22, and also there is a difference in area between the relatively large display element 22 and the relatively small display element 23. It is necessary to drive the display elements while changing a pulse width in correspondence with at least several kinds of areas.

Figure 3:
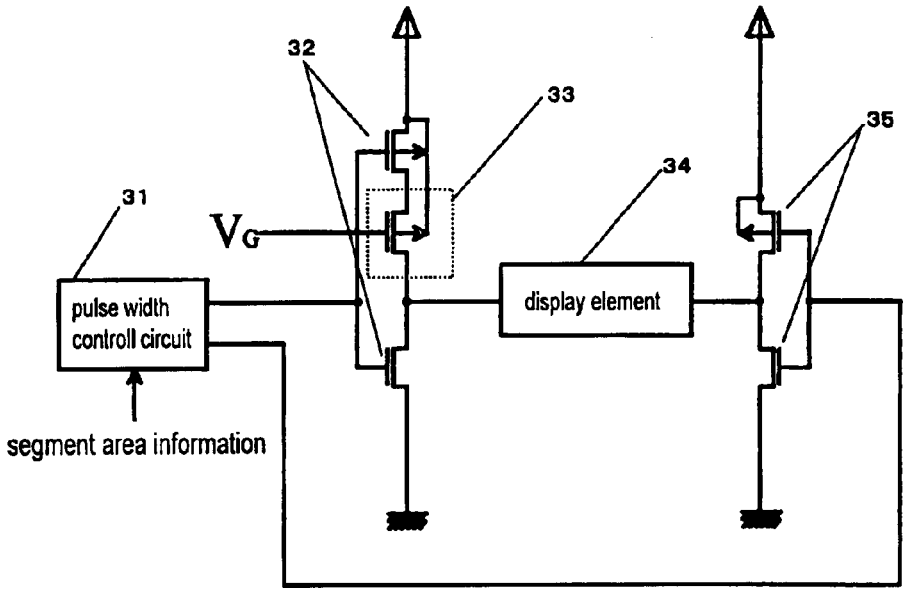
FIG. 3 is a circuit diagram for explanation of a driving current control in accordance with the present invention.

FIG. 3 is a circuit diagram showing a configuration of a concrete example of the drive current control of the present invention. In the light emitting elements display device in which a plurality of display elements which are different in area from one another are arranged in a matrix, a common electrode through which a plurality of display elements are selected is electrically connected to an inverter 35, and electrodes through which the display data is written to a plurality of display elements are electrically connected to both of a constant current FET 33 and an inverter 32. A pulse width control circuit 31 supplies a signal which is used to select a plurality of display elements to the inverter 35 and supplies a signal which is used to carry out the on/off control along to the area information of the respective display elements which have been selected within a selection time to the inverter 32. In addition, the frame frequency is made about 60 Hz in order to prevent the flicker from appearing.

Next, with respect to the generation of the area data of the display elements, the digital data corresponding to the display element area is previously prepared in a ROM (Read Only Memory), and the area data is read out from the ROM in correspondence to the display elements each of which emits light to be used to set the pulse width. In this connection, the ROM may be a programmable one.

As a result, the amount of current per area of each of the display elements becomes fixed, and hence the light emission luminances of the display elements become apparently, roughly equal to one another.

Figure 4:
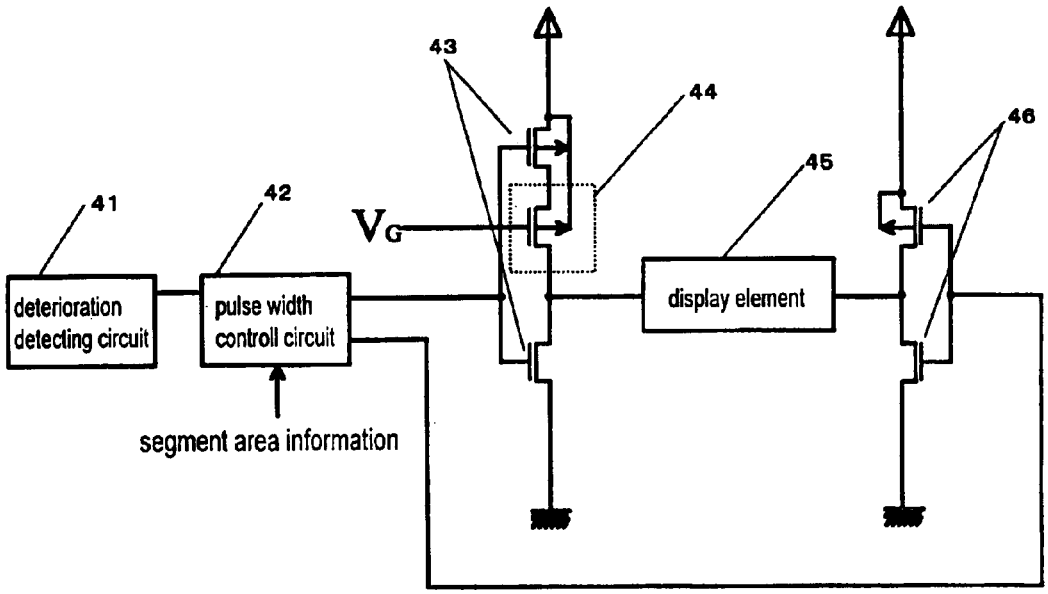
FIG. 4 is a circuit diagram for explanation of another driving current control in accordance with the present invention.
Figure 5:
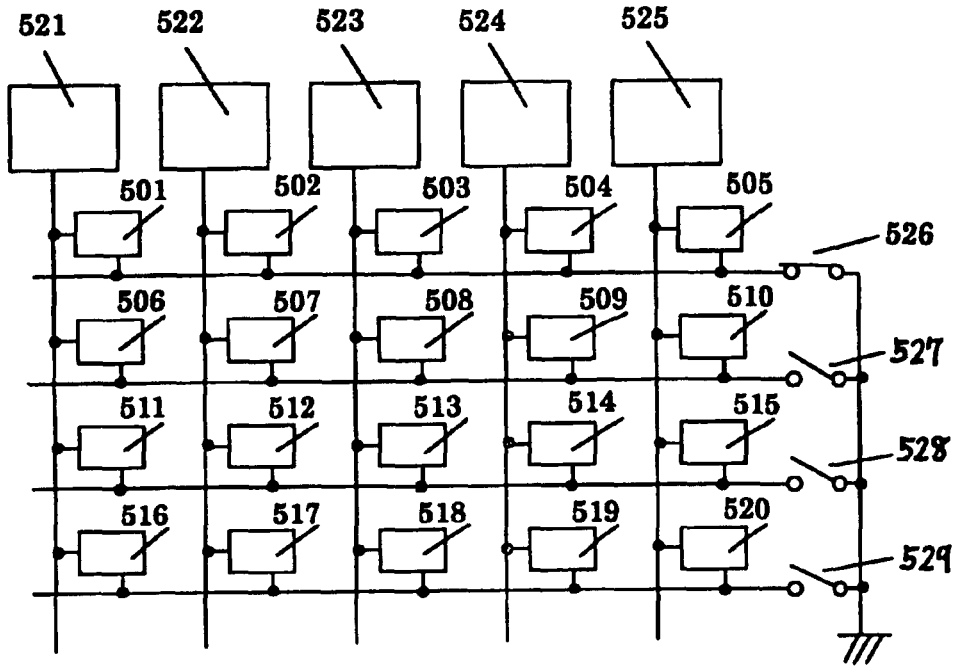
prior art Fig. 5
FIG. 5 is a circuit diagram showing a conventional example.
Figure 6:
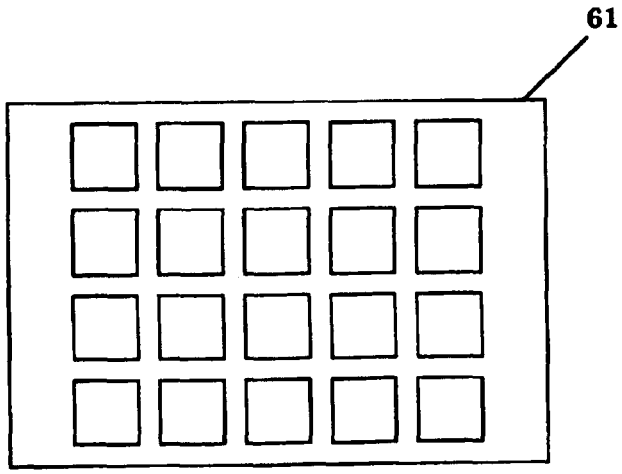
prior art Fig. 6
FIG. 6 is a plan view showing a light emitting indicator in the conventional example.

FIG. 4 is a circuit diagram showing a configuration of another drive current control of the present invention. In the light emitting elements display device in which a plurality of display elements which are different in area from one another are arranged in a matrix, a common electrode through which a plurality of display elements are selected is electrically connected to an inverter 46, and electrodes through which the display data is written to a plurality of display elements are electrically connected to both of a constant current FET 44 and an inverter 43. A frame modulating circuit 42 supplies a signal which is used to select a plurality of display elements to the inverter 46 and supplies a signal which is used to carry out the signal to change the times to be turned on/off along with the degradation information from the area information of the respective display elements and a degradation detecting circuit 41 to the inverter 43. In addition, the frame frequency is made about 1000 Hz in order to prevent the flicker from appearing.

The degradation detecting circuit 41 makes the gate voltage VG of the constant current FET rise up to the power source voltage, and measures the current value which is obtained when only the specific display element 45 is turned ON to write the data to the RAM. In addition, this operation does not need to be carried out at all times and hence may also be carried out once a day or a week.

As described above, the light emission luminances can be kept constant using both of the area information which is prepared in a similar manner to that of the above-mentioned embodiment and the above-mentioned degradation information.

As was described above, according to the light emitting indicator drive circuit of the present invention, even in a fine character display and a segment display which is low in power and low in cost, a variation in luminance between the respective segments can be reduced to a level where an operator is hardly aware of the variation. For that reason, if the light emitting indicator drive circuit is applied to a product such as a wristwatch which requires a small size, a lower power, low cost and high fashion, the degree of completion of the product can be enhanced. Thus, the present invention can obtain large advantages.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A light emitting display device comprising:

a light emitting indicator having a plurality of light emitting elements for emitting a light in response to application of a current, at least some of the light emitting elements having different areas;

a constant-current source comprising a FET connected to each light emitting element for supplying a current to the respective light emitting elements;

an inverter connected to each FET for controlling an output power of the constant-current source; and a pulse width control circuit for setting the pulse width of a driving waveform of the inverter according to the areas of the respective light emitting elements so that the luminance of the respective light emitting elements is maintained substantially equal to one another.

2. A light emitting display device according to claim 1; further comprising means for storing area data representing areas of the plurality of light emitting elements; and wherein the pulse width control circuit reads the area data and corrects the pulse width of the driving waveform of the inverter to maintain the luminance of the respective light emitting elements substantially equal.

3. A light emitting display device according to claim 1; wherein the light emitting indicator comprises a segmented display having the light emitting elements arranged in the form of a figure.

4. A light emitting display device according to claim 1; wherein the light emitting indicator comprises a display having a plurality of seven-segment digits.

5. A light emitting display device according to claim 1; further comprising a deterioration detecting circuit for detecting deterioration of a light emitting characteristic of the respective light emitting elements; and a signal processing circuit for processing deterioration information output by the deterioration detecting circuit and area information of the plurality of elements and controlling the pulse width control circuit to reduce variations in luminance between the respective light emitting elements caused by different areas of the respective light emitting elements, and to maintain the luminance of each respective light emitting element constant to compensate for deterioration of the light emitting characteristic of each respective light emitting element.

6. A light emitting display device according to claim 1; further comprising a signal processing circuit for processing area information of the plurality of light emitting elements and outputting data to the pulse width control circuit to maintain the luminance of the respective light emitting elements substantially constant.

7. A light emitting display device comprising:

a light emitting indicator having a plurality of light emitting elements for emitting a light in response to application of a current, at least some of the light emitting elements having different areas;

a constant-current source comprising a FET connected to each light emitting element for supplying a current to the respective light emitting elements;

an inverter connected to each FET for controlling an output power of the constant-current source; and a frame modulating circuit for performing frame modulation in accordance with the areas of the respective light emitting elements so that the luminance of the respective light emitting elements is maintained substantially equal to one another.

8. A light emitting display device according to claim 7; further comprising a deterioration detecting circuit for detecting deterioration of a light emitting characteristic of the respective light emitting elements; and a signal processing circuit for processing deterioration information output by the deterioration detecting circuit and area information of the plurality of elements and controlling the frame modulating circuit to reduce variations in luminance between the respective light emitting elements caused by different areas of the respective light emitting elements, and to maintain the luminance of each respective light emitting element constant to compensate for deterioration of the light emitting characteristic of each respective light emitting element.

9. A light emitting display device according to any one of claims 1 to 8; wherein the indicator is an organic EL element.

10. A light emitting display device according to claim 7; wherein the light emitting indicator comprises a segmented display having the light emitting elements arranged in the form of a figure.

11. A light emitting display device according to claim 7; wherein the light emitting indicator comprises a display having a plurality of seven segment digits.

* * * * *